United States Patent [19]

Jacquelin et al.

[11] 3,959,570

[45] *May 25, 1976

[54] APPLICATION OF PRECIPITATES OF METHYLENE UREAS AND PRODUCTS OBTAINED

[75] Inventors: Guy Jacquelin; Solange Sangenis, both of Grenoble, France

[73] Assignee: Centre Technique de l'Industrie des Papiers Cartons et Celluloses, Grenoble Cedex, France

[ * ] Notice: The portion of the term of this patent subsequent to Mar. 4, 1992, has been disclaimed.

[22] Filed: Oct. 24, 1974

[21] Appl. No.: 517,413

Related U.S. Application Data

[63] Continuation-in-part of Ser. No. 41,374, May 28, 1970, Pat. No. 3,869,311.

[52] U.S. Cl. ..... 428/478; 106/148; 106/214; 106/288 Q; 162/166; 162/168 N; 260/6; 260/17.3; 260/69 R; 260/851; 428/511; 428/530; 428/535

[51] Int. Cl.[2] ..... B32B 9/02; B32B 9/04; D21H 1/28

[58] Field of Search ..... 106/288 Q, 148, 214; 117/154, 155 L; 260/6, 17.3, 69 R, 851; 162/166, 168; 428/478, 511, 530, 535

[56] References Cited

UNITED STATES PATENTS

| | | | |
|---|---|---|---|
| 2,399,489 | 4/1946 | Landes | 117/155 X |
| 2,652,374 | 9/1953 | Thompson | 117/155 X |
| 2,851,424 | 9/1958 | Switzer et al. | 117/33.5 X |
| 2,956,898 | 10/1960 | Fleck | 117/33.5 T |
| 3,018,287 | 1/1962 | Fleck | 117/33.5 X |
| 3,181,950 | 5/1965 | Koerher et al. | 96/82 |

*Primary Examiner*—Michael R. Lusignan
*Attorney, Agent, or Firm*—Charles E. Baxley

[57] ABSTRACT

A method of manufacture from a predetermined material, especially from a natural fibrous material and/or synthetic fibrous material of an article, in particular a sheet for printing or reproduction, which combines superior qualities of brightness, opacity, thermal stability, insolubility and lightness, said method consisting of laoding said material throughout its mass or superficially, with a filler product having a base of a methylene urea precipitate with a low degree of polymerization, obtained by the reaction of urea on formaldehyde in an acid medium.

12 Claims, 4 Drawing Figures

Figure 1:
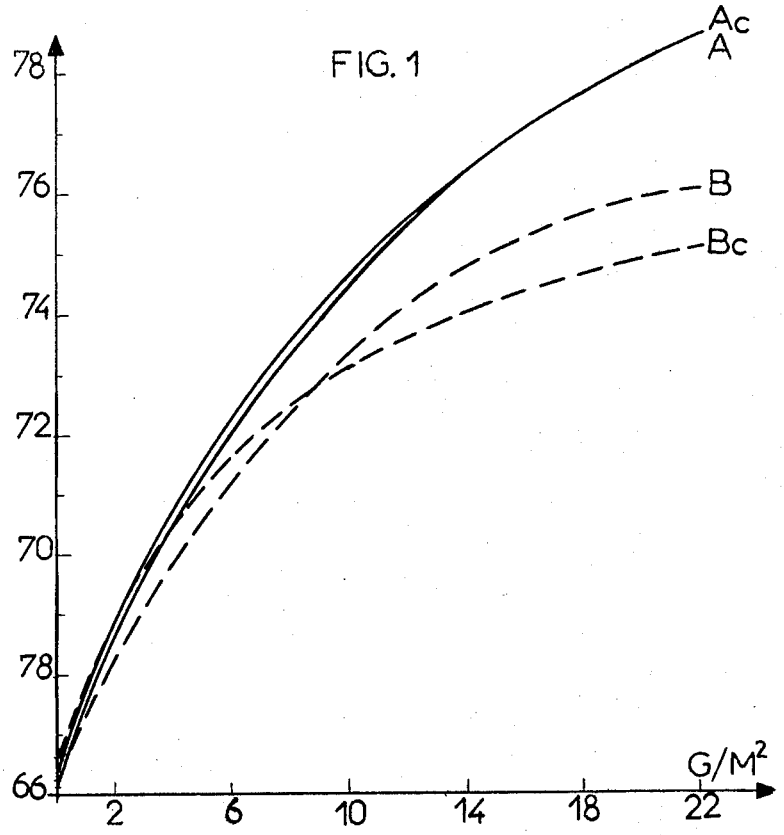

Ac
A
B
Bc
78
76
74
72
70
78
66
G/M²
2
6
10
14
18
22

D
C
Cc
Dc
92
90
88
86
84

G/M²
2
6
10
14
18
22

APPLICATION OF PRECIPITATES OF METHYLENE UREAS AND PRODUCTS OBTAINED

CROSS REFERENCE

This is a continuation-in-part application with respect to copending U.S. application 41,374 filed May 28, 1970, now U.S. Pat. No. 3,869,311, patented March 4, 1975.

INVENTION

The present invention relates to a method of preparation, from a predetermined material, in particular from a natural fibrous material and/or synthetic fibrous material of an article which combines high qualities of brightness, opacity in the visible spectrum, transparency to ultraviolet rays, stability to light and heat, insolubility and lightness. This method is more particularly intended to be applied to the manufacture of special sheets, i.e. paper sheets for reproduction, printing and/or absorbent papers. The invention also relates to an article, in particular a paper, obtained by the above-mentioned method.

Condensation products of urea and formaldehyde have formed the subject of numerous studies, and industrial products manufactured from these reactants are also numerous. According to the relative proportions of urea and formol, and the conditions of reaction, there are obtained resins for molding, adhesives, adjuvants for textiles, paper making, etc. However, for these manufactures, the reactants are utilized in a slightly acid medium. In fact, in a highly acid medium there are formed white precipitates of methylene urea having a low degree of polymerization, known as "Goldschmidt" products which are undesirable for these manufactures.

The applicants having brought into evidence these special characteristics of brightness, opacity in the visible spectrum, transparency to ultraviolet rays, stability to light and to heat, insolubility and lightness which are possessed by these precipitates have discovered a new applications of these latter. The applicants have developed a method of manufacture from a predetermined material, especially from a natural and/or synthetic fibrous material, of an article which combines the superior qualities mentioned above.

The method according to the invention consists of charging said article, throughout its mass or superficially, with a filler product having a base of a precipitate of methylene urea having a low degree of polymerization, obtained by the reaction of urea on formaldehyde in an acid medium.

This filler product permits the above mentioned characteristics to be given to the base material and produces an article having advantageous qualities for various branches of the technical art, especially the branch of synthetic materials or paper making products. The filler product with a base of precipitate of methylene urea is particularly suitable to this latter case, due to its opacity to visible light and its transparency to ultraviolet rays. In fact, certain special papers for reproduction necessitate good opacity to visible light, combined with maximum transparency to ultraviolet rays. In addition, its physical characteristics permit a mat appearance to be obtained in the paper, this appearance being desirable for certain printing papers.

In the application to printing support such as paper making products of the method of manufacture according to the invention, the filler product is preferably applied in the form of a superficial coating on a paper or like support. However, the filler product could be, alternately mixed with the slurry of natural and/or synthetic fibrous material before the making of the paper or like support by conventional methods. Thus, the filler will be loaded throughout the mass of the final sheet of paper. It is obvious for a paper maker to operate as disclosed above. In the case of the filler product being coated on the paper, it is composed of an aqueous suspension of a precipitate of methylene urea and the binders and adjuvants usually employed in coating compositions, e.g., a dispersing agent, casein, latex of the styrene butadiene type or the like. The material obtained is a printing paper or the like which has especially qualities of opacity, brightness and mat surface which are improved for reduced weight as compared with standard papers or the like, and in particular papers or the like coated with compositions having a kaolin base.

A comparison of the same paper support coated on the one hand with the composition according to the invention and on the other hand with a conventional composition with a base of kaolin makes it possible to bring into evidence, for an equal weight of coating per unit surface, a substantial increase in brightness in the case of the formaldehyde urea precipitate. The opacities are very close in the two cases, but the effect of calendering the paper is, from the point of view of optical characteristics, unfavorable to the composition with a base of kaolin, whereas it does not modify the optical characteristics of the coating with a base of formaldehyde urea precipitates.

In addition, for equal proportions by weight of binder, the pick-strength of the coatings with a base of formaldehyde urea precipitate is higher or equal to that of the coatings with a base of kaolin. For an equal volumetric concentration of pigment, this strength is greater in the case of coatings with a base of formaldehyde urea precipitate.

By way of example, there is given below the composition of a surface coating which may, amongst others, be applied on a natural and/or synthetic fibrous material such as a paper AFNOR IV: 100 parts of formaldehyde urea precipitate, 15 parts of casein, 10 parts of styrene butadiene latex and 0.6 parts of dispersant in suspension in 293 parts of water.

The content of dry material in a composition of this kind is approximately equal to 30% and its Brookfield viscosity (axis No. 1, 100 r.p.m.) is 80 centipoises.

There are given below two methods of manufacture with a good yield of a formaldehyde urea precipitate. The first method consists in carrying out the following operations in order to obtain 355.3 grams of precipitate:

Add 228 cu.cm. of water and 1055 grams of a 30% urea solution (dry weight of urea 316.5 grams) to 496.7 grams of a formaldehyde solution having 30.2% by weight of HCHO (weight of pure HCHO = 150 grams) and the pH value of which has been adjusted to 6.2 by the addition of a decinormal base, especially of sodium hydroxyde. In these conditions, the pH value of the mixture is 8.8, the temperature is 20.4°C and the formaldehyde/urea ratio is 0.47 by weight and 0.95 in mols;

Leave the mixed product to react at ambient temperature for 120 min. with moderate stirring; the pH value then becomes 8.0 and the temperature rises to 23.6°C.

Add 2 liters of water and 750 cu.cm. of normal acid, especially hydrochloric acid; this dilution and acidification cause an increase in temperature which reaches a maximum of 31.3°C at the end of about 12 minutes;

Allow the products to react, with moderate stirring, for 60 minutes; during the course of this reaction, the pH value is approximately equal to 1;

Filter and wash the precipitate obtained until it is neutral, and then dry it, especially in a ventilated stove at 100°–105°C., until the weight is constant.

Under these conditions there are obtained 355.3 grams of precipitate which represent 76.2% of the total initial weight of urea and formaldehyde.

The other method of manufacture, with an almost identical yield, consists in carrying out the following operations in order to obtain 237 grams of precipitate:

Add 80 cu.cm. of water, 200 grams dry urea and 1.5 grams of a dispersing agent to 353.4 grams of a formaldehyde solution having 28.3% by weight of HCHO (weight of pure formaldehyde 100 grams) and in which the pH value has been adjusted to 6.3 by the addition of a decinormal base, especially of sodium hydroxyde. Under these conditions, the formaldehyde/urea ratio is 0.5 by weight and 1.0 in mols;

Stir in reaction medium for 10 minutes; the dissolution of the urea is accompanied by a fall in temperature to about 6°C.

Add 27.4 cu.cm. of a twice normal acid solution, especially of hydrochloric acid, and stir the mixture violently. A white precipitate is formed a few minutes after acidification, the reaction is exothermic and the temperature reaches 73°C at the end of about 9 minutes;

After this time (09 minutes) cool the mixture obtained by pouring it into a large volume of cold water;

Filter, wash and dry the precipitate in the same way as for the method already described.

There are thus obtained 237 grams of precipitate, which corresponds to 79% of the initial weight of urea and formaldehyde.

It will of course be understood that the various values given for these methods of manufacture can be subject to modifications: in particular, the granular size of the product obtained can be regulated by acting on the concentrations, the temperature and the stirring of the medium at the moment of acidification.

The precipitate of methylene urea obtained especially by these methods of preparation, appears in the form of small spheres exhibiting the optical phenomenon of the Maltese cross, similar to that which is observed on grains of native starch, with a stratified structure. The physical characteristics of this precipitate are as follows:

Melting point comprised between 235° and 250°C.

Volume mass comprised between 1.00 and 1.70 grams per cu.cm., pH value of the isoelectric point comprised between 4 and 7, Proportion of nitrogen (Kjeldahl) comprised between 30 and 38%

The index of refraction of this precipitate is comprised between 1.4 and 1.6; the following Table gives the factor of diffuse reflection for two precipitates, one corresponding to a molar ratio of formaldehyde/urea of 0.95, the other to a ratio of 1.9. The measurements were made by means of an Elrepho photometer calibrated with respect to MgO by taking 100% as the reflection factor for MgO

| Maximum wave-length in micrometers | Diffuse reflection factor % | |
|---|---|---|
| | Formaldehyde/urea =0.95 | Formaldehyde/urea =1.90 |
| 0.420 | 98.0 | 95.9 |
| 0.461 | 98.1 | 96.3 |
| 0.492 | 98.6 | 97.0 |
| 0.534 | 98.7 | 97.6 |
| 0.570 | 98.9 | 97.7 |
| 0.620 | 99.1 | 98.1 |
| 0.680 | 99.2 | 98.3 |

Furthermore, the brightness index measured under the same conditions with a filter R 457 is equal to 98.2 for the first precipitate and 96.4 for the second.

It should be observed that these precipitates of methylene urea may also be obtained by more direct syntheses involving for example the use of a direct reaction of carbon monoxide on ammonia at high pressure in the presence of a catalyst.

The invention also relates to sheet of cellulosic fibrous and/or synthetic material such as a paper, particularly intended for printing and manufactured by the method described above; according to the invention, this paper is charged with a superficial coating layer with a base of methylene urea precipitate.

By way of illustration, there is given below the composition of a coating paste together with the properties of the coated paper obtained.

The support paper for the coating may be for example an AFNOR IV paper and the composition by weight of the surface coating is as follows:

100 parts of methylene urea precipitate;

15 parts of casein;

10 parts of styrene butadiene latex;

0.6 part of a dispersing agent;

293 parts of water.

Reference will now be made to the accompanying drawings in order to appreciate the properties of the coated paper obtained. In these drawings FIG. 1 represents:

a curve A giving the brightness of the abovementioned paper, not calendered, as a function of the dry weight of deposited coating (ing/sq.m.);

A curve $A_c$ giving the brightness of the above paper, calendered, as a function of the dry weight of coating deposited (ing/sq.m.);

A curve B giving by way of comparison the brightness of a non calendered paper obtained by coating, on an identical paper support, with a standard composition with a base of kaolin having an equal proportion of binder by weight:

A curve $B_c$ giving the brightness of this latter paper after calendering.

The calendering operations were carried out by three passes through the "Ramisch" calender (two tonnes).

By comparison of these curves, it is noted that the calendering has a very slight influence on the papers according to the invention, since the curves A and $A_c$ are practically coincident. There is also observed a substantial gain in brightness for equal weights of coating, in the case of the use of the methylene urea precipitate as a coating pigment.

Figure 2:
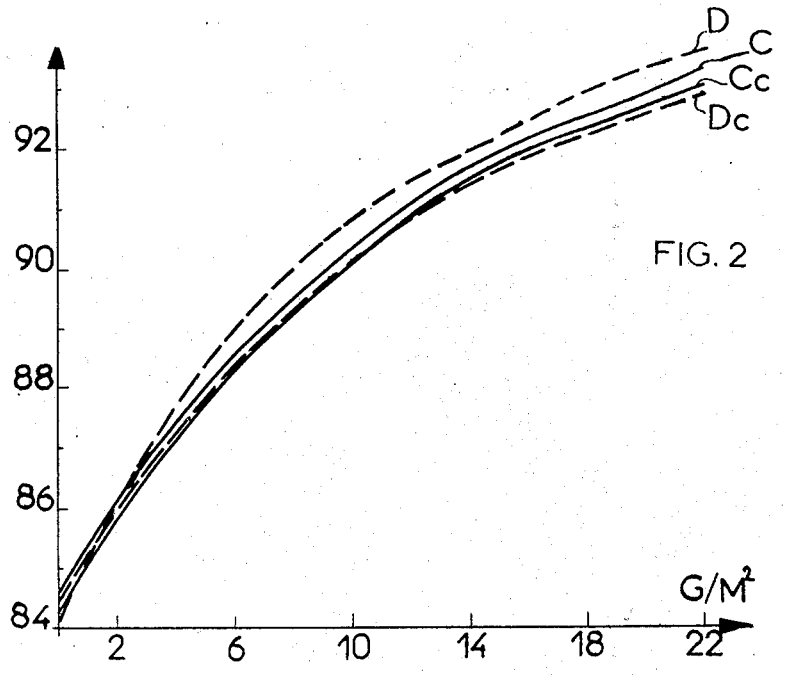
Figure 3:
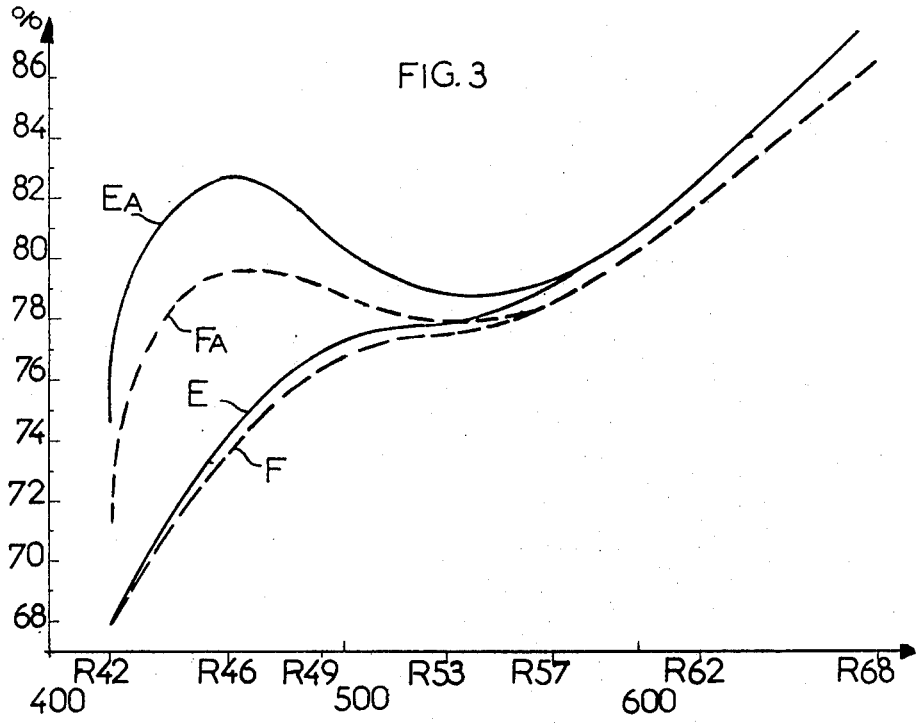

FIG. 2 shows curves C, $C_c$, D and $D_c$, giving the opacity on a white backing (according to standard NF-Q03.206) of the four cases of papers referred to above, as a function of the dry weight of coating deposited (in g/sq.m.)

From these curves it can be seen that the opacities are very close for noncalendered papers coated with methylene urea precipitate or with kaolin. However, the effect of the calendering is slightly unfavorable to the composition with a kaolin base, whereas it practically does not modify the optical characteristics of the paper with a base of the methylene urea precipitate.

In addition, the papers coated by a filler product with a base of methylene urea precipitate have a high microporosity, but also a macroporosity which may be high.

Furthermore, the transparency to ultraviolet rays of this filler material makes it possible to obtain a high efficiency with optical brightness. Thus the composition may comprise up to 1.5% of these agents by weight of the filler introduced.

According to a preferred method of addition of the optical brightner, the latter is fixed on the methylene urea at the time of manufacture of this latter.

FIG. 3 represents:

a curve E giving, as a function of the maximum wavelength, the diffused reflection factor of a paper coated with 13.5 of a coating with a base of methylene urea precipitate, without optical brightner.

A curve $E_a$ giving as a function of the maximum wavelength, the diffuse reflection factor of a paper coated with the same weight of a coating with a base of methylene urea precipitate containing 0.87% of optical brightner with respect to the dry extract of the coating bath;

By way of comparison, curves F and $F_A$ similar to the curves E and $E_A$ for a paper with a coating of a kaolin base.

These measurements were carried out with Xenon lighting.

By means of these curves, it can be seen that for an equal weight of coating deposited the optical brightner is more effective when the filler has a base of methylene urea precipitate.

Figure 4:
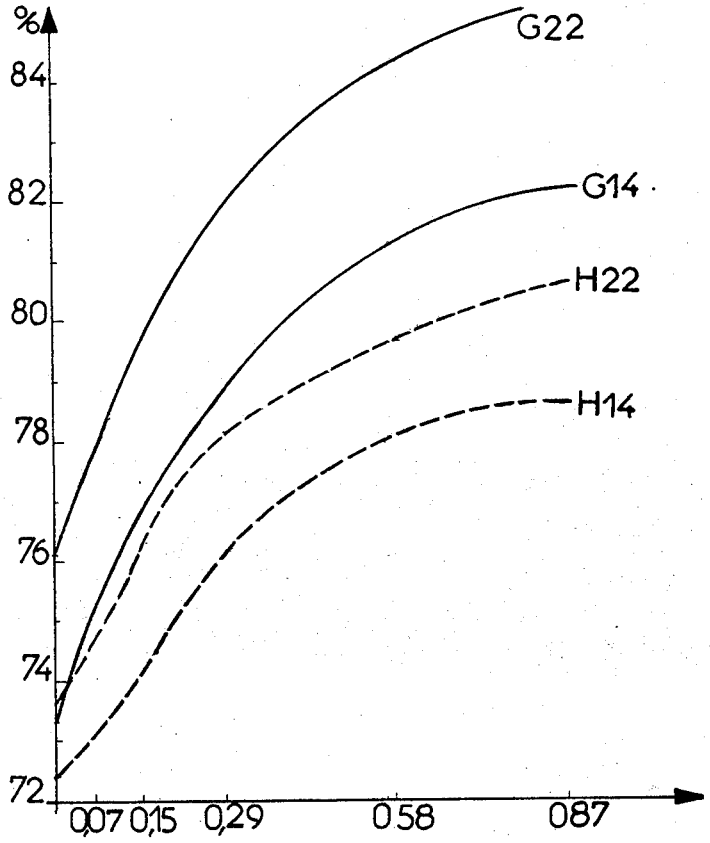

This conclusion is confirmed in FIG. 4 which represents:

A curve $G_{14}$giving, as a function of the proportion of optical brightner with respect to the dry materials of the coating baths, the diffuse reflection factor of a paper coated with 14 g/sq.m. of a coating with a base of methylene urea precipitate;

A similar curve $G_{22}$ for a paper coated with 22 g/sq.m. of the same coating;

By way of comparison, curves $H_{14}$ and $H_{22}$ similar to the curves $G_{14}$ and $G_{22}$, but for a coating with a base of kaolin.

These measurements were carried out with Xenon lighting in the presence of a filter R 457.

The optical brightner is more effective in the case of a coating with a base of methylene urea precipitate, the difference being greater as the thickness of the coating is increased.

To the characteristics enumerated are added other properties of papers with coatings having a base of methylene urea precipitate, such as for example their fireproofing, antiparasitic and anticryptogamic properties.

In addition it will be noted that the methylene urea precipitates are relatively economical materials. This advantage is accentuated, by reason of their low density in comparison with mineral fillers which are two or three times more dense; for equal weights, the effective surface coated by coatings with a base of methylene urea precipitate is greater. This factor is particularly advantageous for papers intended for printing, for which increased lightness is desired for a given opacity.

It will of course be understood that the present invention is not limited to the terms of the foregoing description, but will comprise on the contrary all the alternative forms and improvements within the scope of those skilled in the art. In particular, there may be applied in identically the same way, similar precipitates obtained from neighboring chemical constituents, in particular derivatives of urea such as thio urea, biuret dicyanodiamide, guanidine, phenyl urea, etc. These products may be employed instead of the urea or in a mixture with this substance.

Similarly, another aldehyde may be partly substituted for the formaldehyde.

We claim:

1. A pigmenting composition having as a base an insoluble methylene urea precipitate having a low degree of polymerization, the methylene urea precipitate having the following properties:

Index of refraction between about 1.4 to 1.6, diffuse reflection factor higher than 95% for an illumination of maximum wavelength between about 0.42 and 0.68 microns, melting point between about 230° to 250°C;, volume-mass between about 1.00 to 1.70 g/cu.cm., pH value of the isoelectric point between about 4 to 7, and a percent of nitrogen between about 30 and 38%.

2. The pigmenting composition according to claim 1 containing by weight:

0–20 parts of a primary binder selected from a group consisting of casein, starch and polyvinyl alcohol, 0.20 parts of a secondary binder selected from a group consisting of styrene butadiene latices and acrylic latices, 0.3–1.0 parts of a dispersing agent and 50.600 parts of a liquid medium per 100 parts of methylene urea precipitate.

3. The pigmenting composition according to claim 1 and having an optical brightner in a proportion by weight of less than 1.5% with respect to the weight of the methylene-urea precipitate.

4. The pigmenting composition according to claim 3 wherein an optical brightner is incorporated in a proportion by weight of less than 1.5%, with the reactants at the moment of manufacture of the methylene urea precipitate.

5. A sheet coated with a pigmenting composition having as a base an insoluble and pulverulent methylene urea precipitate having a low degree of polymerization, the methylene urea precipitate having the following properties:

index of refraction between about 1.4 to 1.6, diffuse reflection factor higher than 95% for an illumination of maximum wavelength between about 0.42 to 0.68 microns, melting point between about 230° to 250° C., volume-mass between about 1.00 to 1.70 g/cu.cm.

pH value of the isoelectric point between about 4 to 7, and a percent of nitrogen between about 30 to 38%.

6. The sheet according to claim 5 wherein the pigmenting composition contains by weight 0–20 parts of a primary binder selected from a group consisting of casein, starch and polyvinyl alcohol, 0–20 parts of a secondary binder selected from a group consisting of styrene butadiene latices and acrylic latices, 0.3–1.0 parts of a dispersing agent and 50–600 parts of a liquid medium per 100 parts of methylene urea precipitate.

7. The sheet according to claim 5 and having an optical brightner in a proportion by weight of less than 1.5% with respect to the weight of the methylene urea precipitate.

8. A sheet having dispersed throughout its mass a pigmenting composition having as a base an insoluble and pulverulent methylene urea precipitate having a low degree of polymerization, the methylene urea precipitate having the following properties:

index of refraction between about 1.4 to 1.6, diffuse reflection factor higher than 95% for an illumination of maximum wavelength between about 0.42 to 0.68 microns, melting point between about 230° to 250°C., volume-mass between about 1.00 to 1.70 g/cu.cm.

pH value of the isoelectric point between about 4 to 7, and a percent of nitrogen between about 30 to 38%.

9. The sheet according to claim 8 wherein the pigmenting composition contains by weight:

0–20 parts of a primary binder selected from a group consisting of casein, starch and polyvinyl alcohol, 0–20 parts of a secondary binder selected from a group consisting of styrene butadiene latices and acrylic latices, 0.3–1.0 parts of a dispersing agent and 50–600 parts of a liquid medium.

10. The sheet according to claim 8 and having an optical brightner in a proportion by weight of less than 1.5% with respect to the weight of the methylene urea precipitate.

11. A sheet according to claim 8 wherein the pigmenting composition is introduced into the slurry from which the sheet is manufactured so that the pigmenting composition is dispersed throughout the mass of the sheet.

12. The sheet according to claim 8 and having an optical brightner in a proportion by weight of less than 1.5% with respect to the weight of the methylene urea precipitate.

* * * * *